US007642458B2

(12) United States Patent
Stockton

(10) Patent No.: US 7,642,458 B2
(45) Date of Patent: Jan. 5, 2010

(54) ENCLOSURE FOR ELECTRICAL RECEPTACLE

(75) Inventor: Darren J. Stockton, Chardon, OH (US)

(73) Assignee: Lincoln Global, Inc., City of Industry, CA (US)

( * ) Notice: Subject to any disclaimer, the term of this patent is extended or adjusted under 35 U.S.C. 154(b) by 0 days.

(21) Appl. No.: 12/128,263

(22) Filed: May 28, 2008

(65) Prior Publication Data

US 2009/0294147 A1 Dec. 3, 2009

(51) Int. Cl.
*H01H 13/04* (2006.01)

(52) U.S. Cl. ..... 174/53; 174/50; 174/58; 174/59; 174/135; 220/3.2; 439/107

(58) Field of Classification Search ..... 174/53, 174/58, 59, 50, 135, 60; 220/3.2, 3.3, 3.5, 220/3.6; 439/107, 131, 142
See application file for complete search history.

(56) References Cited

U.S. PATENT DOCUMENTS

| | | | | |
|---|---|---|---|---|
| 6,191,361 | B1 * | 2/2001 | Matty | 174/53 |
| 6,963,029 | B1 * | 11/2005 | Rivers et al. | 174/58 |
| 7,205,488 | B2 * | 4/2007 | Riner | 174/482 |
| 7,241,952 | B2 | 7/2007 | Dinh | |

* cited by examiner

*Primary Examiner*—Dhiru R Patel
(74) *Attorney, Agent, or Firm*—Hahn Loeser + Parks LLP; Keith J. Marcinowski

(57) ABSTRACT

An enclosure for an electrical receptacle includes walls having one or more recesses for receiving associated electrical conductors. The recesses may be covered by at least a first membrane enclosing the recess. The conductors may be manually inserted through the membrane wherein the membrane and/or the recess is self-sealing to automatically encapsulate the girth of the associated electrical conductors.

15 Claims, 6 Drawing Sheets

ENCLOSURE FOR ELECTRICAL RECEPTACLE

TECHNICAL FIELD

The present invention pertains to enclosures for electrical receptacles, and more particularly, to enclosures that inhibit liquid from entering the enclosure.

BACKGROUND OF THE INVENTION

The NEC (National Electrical Code) is a code developed by the National Fire Protection Association, NFPA, for the safe installation of electrical wiring and equipment. It is part of the National Fire Codes series published by the NFPA. The NEC codifies the requirements for safe electrical installations into a single, standardized source. Its contents cover definitions and rules for installation of general purpose and specialty equipment. Many jurisdictions including those outside of the United States adopt the NEC as the standard by which electrical components are constructed and installed.

Sections of the NEC stipulate under what conditions a specific component is needed and how it is to be used. For example, Article 210 addresses branch circuits, receptacles and fixtures on branch circuits. There are requirements for the minimum number of branches and placement of receptacles, according to the location and purpose of the receptacle outlet. A ground fault circuit interrupter (GFCI) is required for all receptacles in wet locations, like bathrooms, kitchens or the outdoors. Restrictions apply to specialty equipment as well, including industrial equipment.

New devices and safer methods of installation are developed from time to time. Such innovations may be adopted by the NEC and incorporated into subsequent editions, which come out every three (3) years. Newly adopted provisions do not necessarily infer that existing technology is faulty or unsafe, but that a new device or method provides improved protection. Take for example the GFCI receptacles mentioned above, which are installed into enclosures. An enclosure typically comprises a box-like structure that is affixed to wall studs or equipment brackets. The enclosure has holes loosely covered by plugs, which are selectively removed and through which the electrical conductors are routed. The enclosures inhibit large particulates from entering the enclosure. However, existing state of the art does not address the problem of liquid or moisture from entering the enclosure.

Accordingly, a need exists for an enclosure that inhibits fluid in various forms from reaching components mounted in the enclosure. One purpose of this invention is to provide such an arrangement with its various attendant advantages. Other purposes will become evident upon reading the disclosure contained herein.

BRIEF SUMMARY

The embodiments of the present invention pertain to an enclosure for electrical receptacles and more particularly to electrical receptacles, like GFCI receptacles, used in moisture ridden environments. The enclosure protects the receptacle from moisture. Accordingly, the enclosure may be sealed to prevent moisture or fluid from penetrating the enclosure and the receptacle which may cause damage or may cause the GFCI receptacle to trip prematurely.

In one embodiment of the present invention, an enclosure for an associated electrical receptacle includes an open front side configured to receive an associated electrical receptacle, a substantially enclosed rear side for inhibiting fluid from entering the associated electrical receptacle enclosure, and one or more sealed recesses fashioned in the substantially enclosed rear side for receiving one or more associated conductors respectively.

In one aspect of the embodiments of the subject invention, the one or more sealed recesses are self-sealing for enclosing around the one or more associated conductors when inserted through the one or more sealed recesses respectively.

In another aspect of the embodiments of the subject invention, the enclosure is a unitary article molded from a thermoplastic elastomer.

In yet another aspect of the embodiments of the subject invention, the enclosure is constructed from Alcryn® or Neoprene®.

In even another aspect of the embodiments of the subject invention, the enclosure further includes at least a first membrane covering the one or more sealed recesses for inhibiting the passage of fluid.

In still another aspect of the embodiments of the subject invention, the at least a first membrane is sufficiently thin to be punctured by inserting the one or more associated conductors into the one or more sealed recesses respectively.

In another aspect of the embodiments of the subject invention, the at least a first punctured membrane encircles the girth of the one or more associated conductors for substantially preventing fluid from passing between the one or more apertures and the one or more conductors.

In yet another aspect of the embodiments of the subject invention, the at least a first membrane is constructed at least in part from a thermoplastic elastomer.

In even another aspect of the embodiments of the subject invention, the diameter of the one or more sealed recesses are undersized with respect to the girth of the associated electrical conductors.

In another aspect of the embodiments of the subject invention, the at least a first membrane is constructed at least in part from a thermoset polymer and/or Alcryn® or Neoprene®.

In still yet another aspect of the embodiments of the subject invention, the open front side further comprises a face having a raised rib for sealing against an associated mounting surface.

In another aspect of the embodiments of the subject invention, the substantially enclosed rear side includes at least a first weep hole.

In still another aspect of the embodiments of the subject invention, the enclosure is substantially symmetrical about a center plane, and wherein the at least a first weep hole comprises a first and at least a second weep hole fashioned on distally opposed sides of the enclosure.

In another embodiment of the subject invention, an article of equipment includes an equipment housing having one or more walls defining a mounting surface and a receptacle opening, one or more electrical conductors operatively disposed with respect to the equipment housing, a receptacle enclosure having an open front side for mounting to the mounting surface and a substantially enclosed rear side for inhibiting the passage of fluid through the receptacle enclosure, the receptacle enclosure having one or more self-sealing recesses for receiving the one or more electrical conductors, and an electrical receptacle sized for mounting within the receptacle enclosure.

In one aspect of the embodiments of the subject invention, the open front side comprises a ledge and a raised rib extended from the ledge for sealing the interface between the receptacle enclosure and the mounting surface.

In another embodiment of the subject invention, a method of installing an electrical receptacle in a receptacle enclosure, includes the steps of providing an electrical enclosure having walls defining an open front side and a substantially enclosed rear side, wherein the substantially enclosed rear side includes one or more self-sealing recesses fashioned in the walls, providing an electrical receptacle for installing in the electrical enclosure having at least a first terminal for receiving at least a first associated electrical conductor, inserting the at least a first associated electrical conductor into the enclosure thereby piercing the self-sealing recesses, and connecting the at least a first associated electrical conductor to the electrical receptacle.

DETAILED DESCRIPTION OF THE INVENTION

Figure 1:
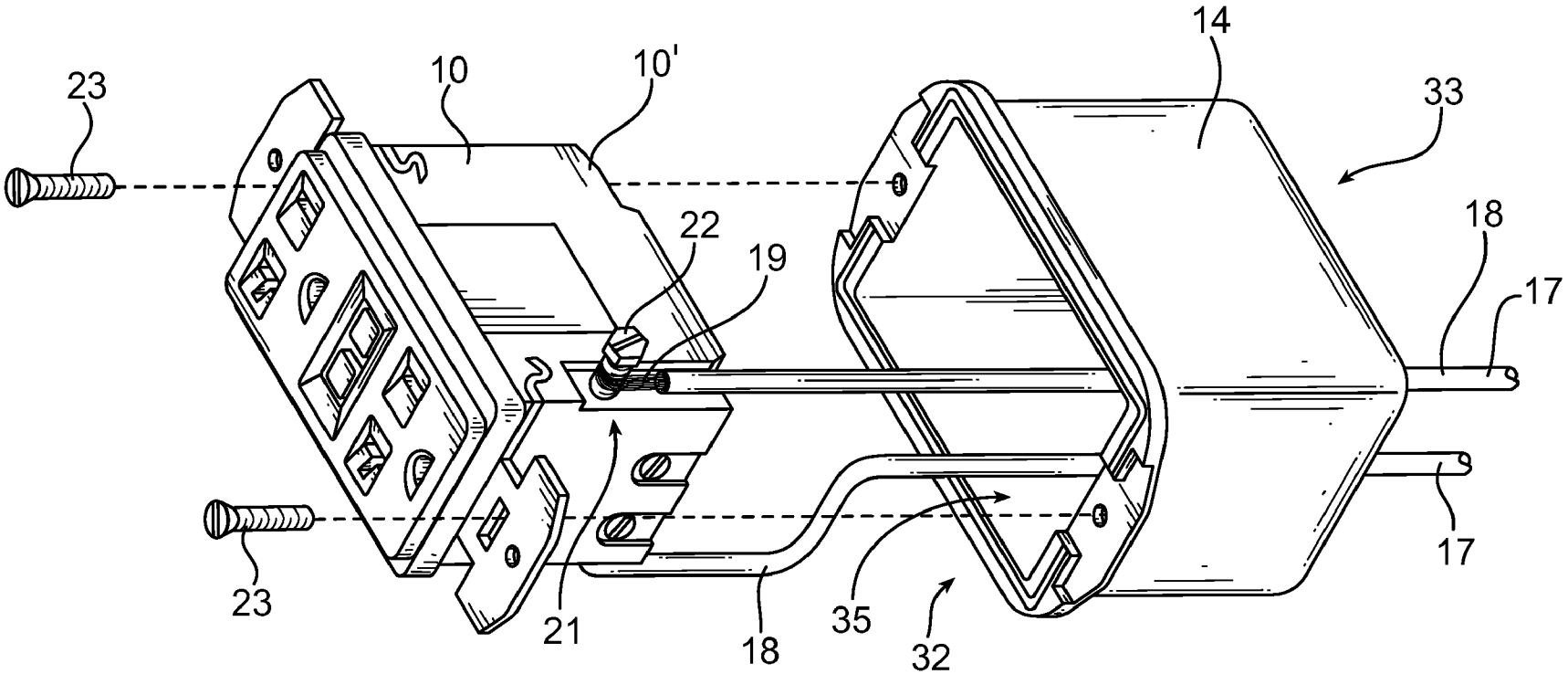
FIG. 1 is an expanded perspective view of an electrical receptacle and enclosure according to the embodiments of the subject invention.

Referring now to the drawings wherein the showings are for purposes of illustrating embodiments of the invention only and not for purposes of limiting the same, FIG. 1 shows an electrical receptacle referenced by numeral 10. The electrical receptacle 10 may be used to communicate electrical power and/or signals between components in an electrical system as may exist for example in dwelling places or units of industrial equipment, which may include welding equipment. In the specification, electrical receptacle may be defined as the female part of an electrical connection or electrical fitting in an outlet or socket. Electrical receptacle 10 may also refer to any electrical component suitable for use within an electrical circuit and housed within an enclosure. The electrical receptacle 10, or receptacle 10 as referred to hereafter, may include circuit interruption capabilities as may be utilized in wet environments. Examples of circuit interruption devices include ground fault circuit interruption receptacles, arc fault circuit interruption receptacles and the like. For illustrative clarity only and not for purposes of limiting the embodiments of the present invention, receptacle 10 will be described herein as a ground fault circuit interruption receptacle 10', also termed GFCI receptacle 10'. However, it is to be construed that any type of receptacle or electrical component may be utilized without departing from the intended scope of coverage of the embodiments of the present invention.

The receptacle 10 may be housed in an enclosure 14, depicted in FIG. 1. Electrical conductors 17 may be routed through the walls 31 of the enclosure in a manner to be described in a subsequent paragraph. The electrical conductors 17 may include sheathing 18, the ends of which may be stripped away to expose bare wire 19. Using methods consistent with good electrical wiring practices, a minimal amount of sheathing 18 is removed and the wire 19 is secured to the appropriate terminal 21 of the receptacle 10, which may incorporate fasteners 22. Multiple electrical conductors 17, or conductors 17, may be connected through the receptacle 10 as needed for a particular application. Once assembled, the receptacle 10 may be inserted into the enclosure 14. It will be realized that additional fasteners 23, which in an exemplary manner may be threaded fasteners 23 designed specifically to thread into thermoplastics, may secure the receptacle 10 to the enclosure 14. Threaded into the actual mounting bracket, the receptacle and enclosure will be secured tightly since the screw is designed not to strip out. Although any other method of affixing the receptacle 10 with respect to the enclosure 14 may be chosen with sound engineering judgment.

Figure 2:
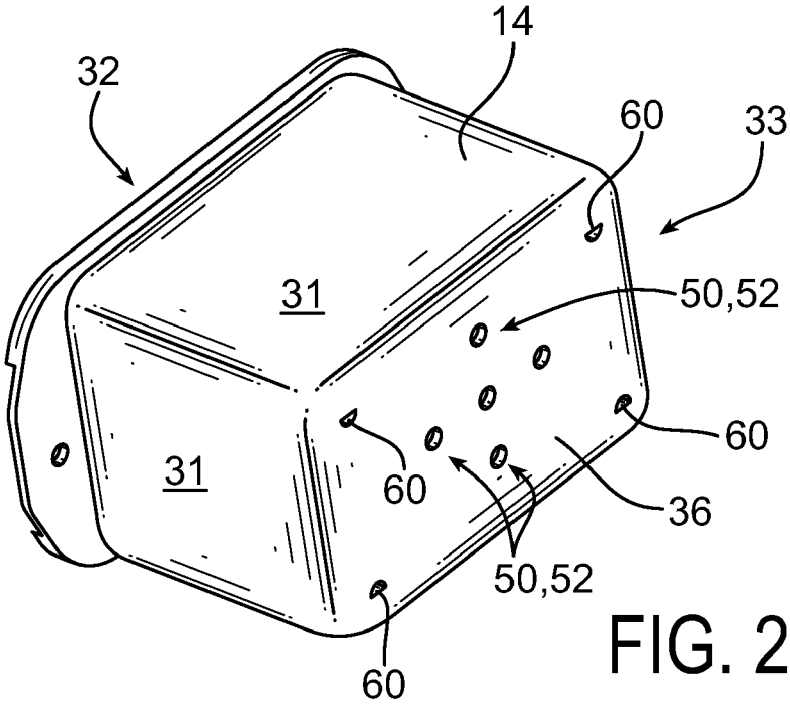
FIG. 2 is a perspective view of an enclosure according to the embodiments of the subject invention.
Figure 2A:
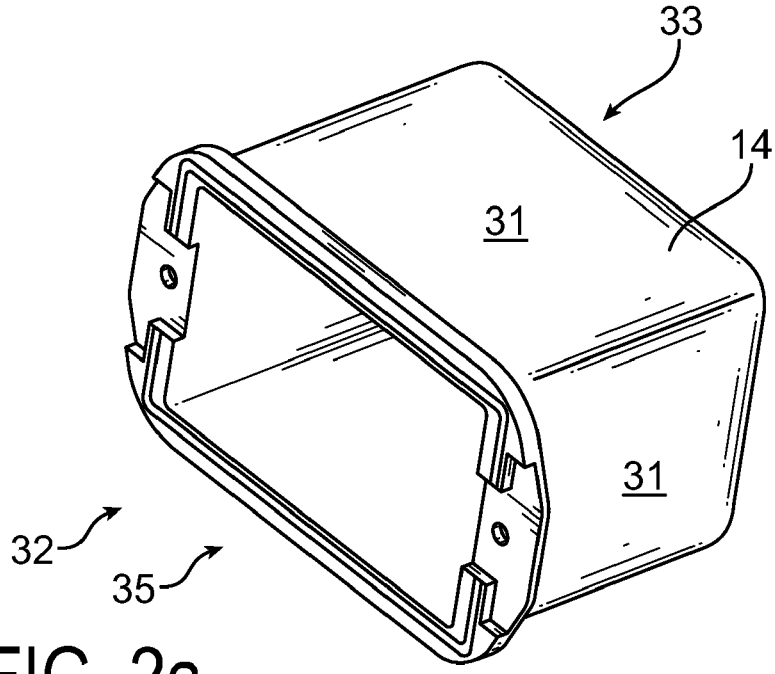
FIG. 2*a* is another perspective view of the enclosure shown in FIG. 2 according to the embodiments of the subject invention.

Referencing FIGS. 1, 2 and 2*a*, the enclosure 14 protects the receptacle 10 from exposure to ambient conditions, like airborne debris or moving objects. As such, the enclosure 14 is generally rigid for shielding the receptacle 10 from contact with unwanted objects. Accordingly, the enclosure 14 may be substantially enclosed, and more particularly may include a substantially enclosed rear side 33. In one embodiment, the enclosure 14 may be constructed to inhibit fluid from entering the enclosure. In this manner, the rear side 33 may comprise a substantially sealed enclosure 14 as will be discussed in detail below. Likewise, the enclosure 14 may also include an open front side 32 for receiving the receptacle 10. In the embodiment incorporating a GFCI receptacle 10', the opening 35 may be sized to provide unrestricted access to a mating electrical plug, not shown. However, other embodiments are contemplated where the receptacle 10, or other electrical component, does not require such direct access or even any access at all. It follows that any size or configuration of open front side 32 may be chosen with sound engineering judgment. In one exemplary manner, the enclosure 14 is generally rectangular or box-like. Walls 31 extend from a base 36 forming a concave enclosure. It is noted here that while the walls 31 are depicted as planar and in orthogonal relationship with each other, curved and/or angled walls 31 are also included within the scope of coverage of the embodiments of the subject invention.

Figure 4:
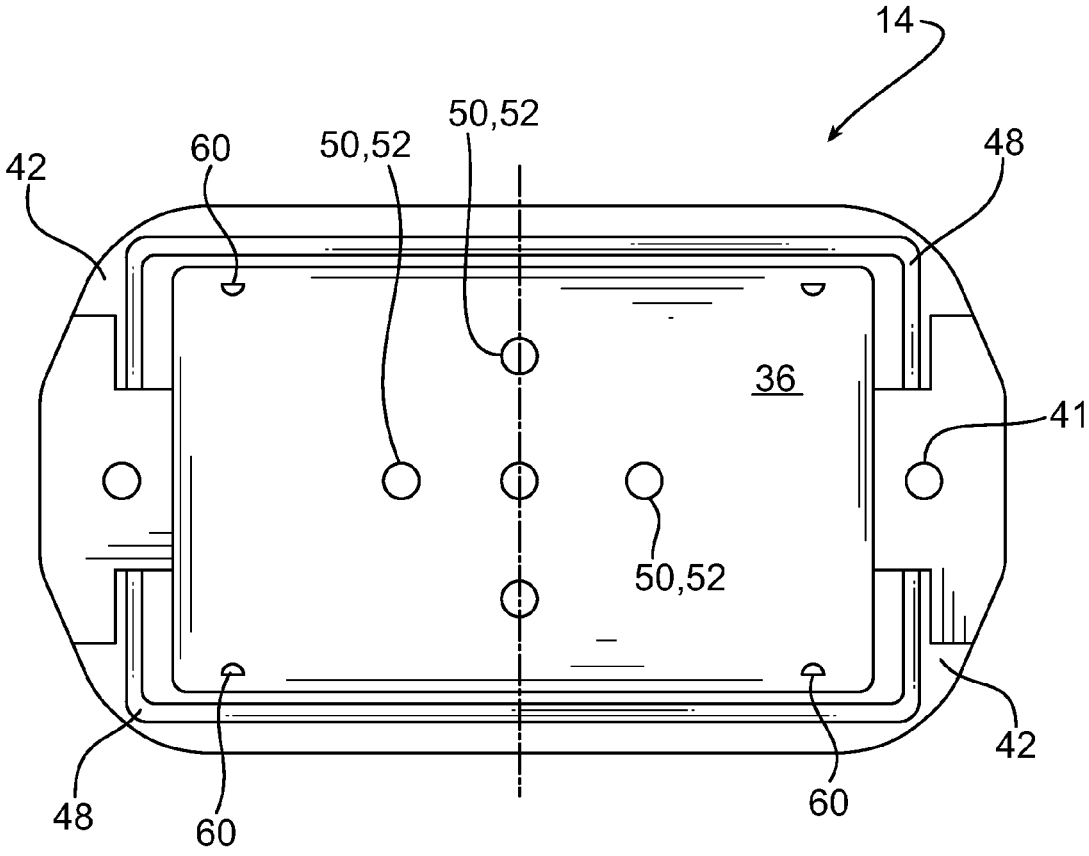
FIG. 4 is an end view of the face of the enclosure according to the embodiments of the subject invention.
Figure 5:
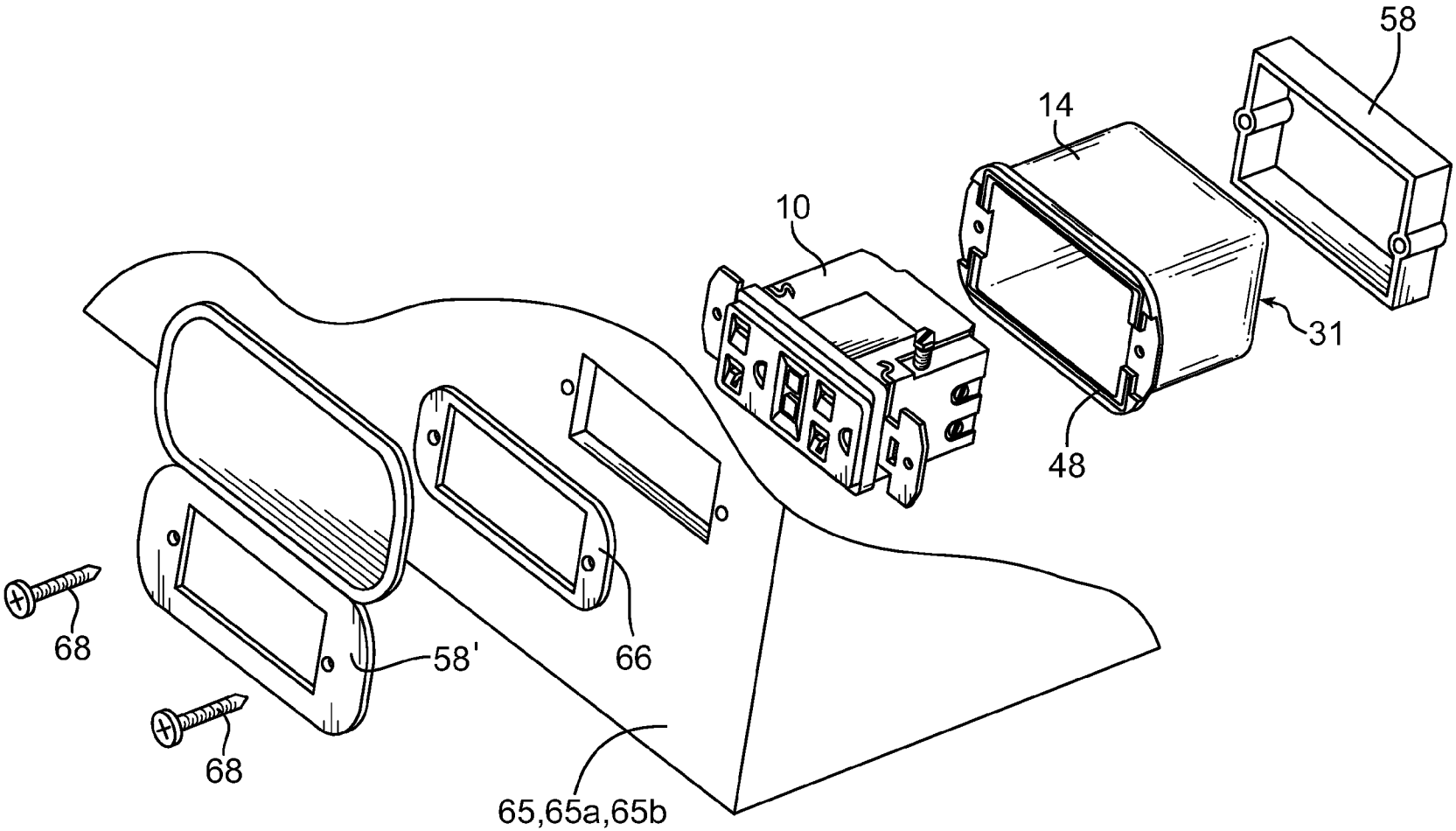
FIG. 5 is a perspective view of an article of equipment having a receptacle and enclosure according to the embodiments of the subject invention.
Figure 6:
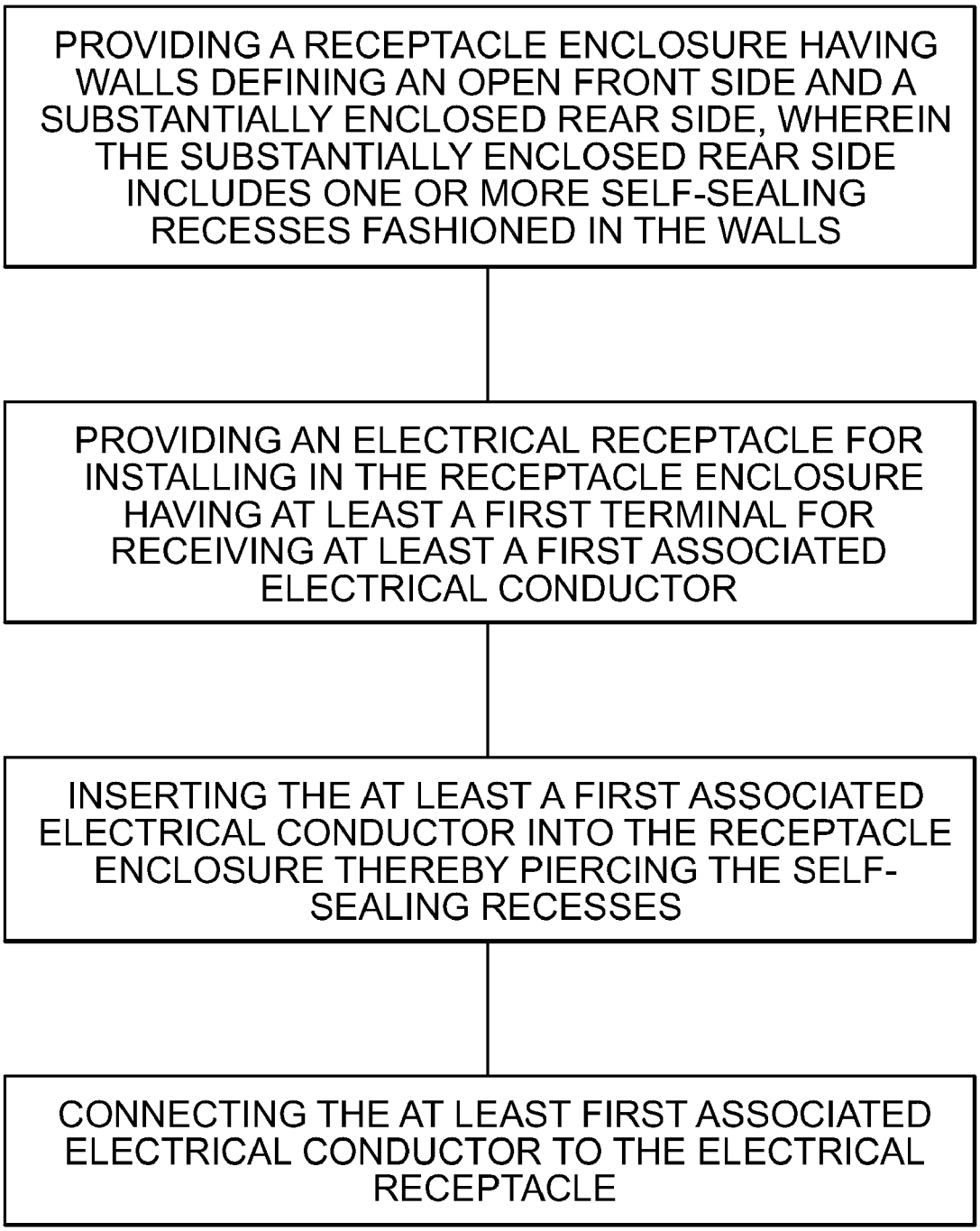
FIG. 6 is a flow chart showing the steps of a method of installing an electrical receptacle and enclosure according to the embodiments of the subject invention.

With reference to FIG. 4, the enclosure 14 may include a front face 40 having a ledge 42 surrounding the opening 35. The front face 40 may be generally planar and utilized to affix the enclosure 14 to a mounting surface as may be found in welding equipment or other structures. Apertures 41 are included in the front face 40 for receiving fasteners 23. In one embodiment, the mounting surface may comprise an interior wall of the welding equipment. The front face 40 may be juxtaposed to the mounting surface and secured thereto by the fasteners 23 or by any other means suitable for use with the embodiments of the subject invention. To seal the area between the mounting surface and the front face 40, i.e. the interface thereof, a raised rib 48 may extend outward from the ledge 42 and substantially around its entire circumference. The rib 48 may be comprised of material suitable for sealing the interface when mounted. In one embodiment, the rib 48 may be integrally fashioned with the enclosure 14. Alternatively, the rib 48 may be applied to the ledge 42 in a subsequent assembly process. In any manner, when the enclosure 14 is juxtaposed to the mounting surface, the rib 48 compresses creating a fluid tight seal around the periphery of the opening 35.

The enclosure 14 may be constructed from a molded polymer. The moldable polymer may be a thermoplastic elastomer, or TPE. As such, the enclosure 14 may be elastically deformable and suitable for inhibiting fluid/moisture from penetrating the enclosure walls 31. Other types of polymers may also be utilized like for example thermoset materials. In one embodiment, Silicon or Alcryn®, manufactured by Advanced Polymer Alloys (a division of Ferro Corporation) may be used to construct the enclosure 14. Persons of ordinary skill in the art will recognize that blends or combinations of materials may also be used. One exemplary process for manufacturing the enclosure 14 may include injection molding. A mold or tool, having one or more cavities in the shape of the enclosure 14, may be forced together. Molten material may then be injected into the mold and allowed to cool or cure depending on the base material. The molded enclosure 14 may then be removed and processed as needed. In that the process of injection molding is well known in the art, no further explanation will be offered at this time. As mentioned above, the rib 48 may be integrally fashioned with the enclosure body, i.e. ledge 42 and thus constructed from the same material. However, it is contemplated that the rib 48 may be fashioned as a separate component and affixed to the enclosure 14. In this case, the material comprising the rib 48 may have a different composition from that of the enclosure walls 31. Still, any manner of fashioning the enclosure 14, the walls 31, the ledge 42 and/or rib 48 may be chosen as is appropriate for use with the embodiments of the subject invention.

Figure 3:
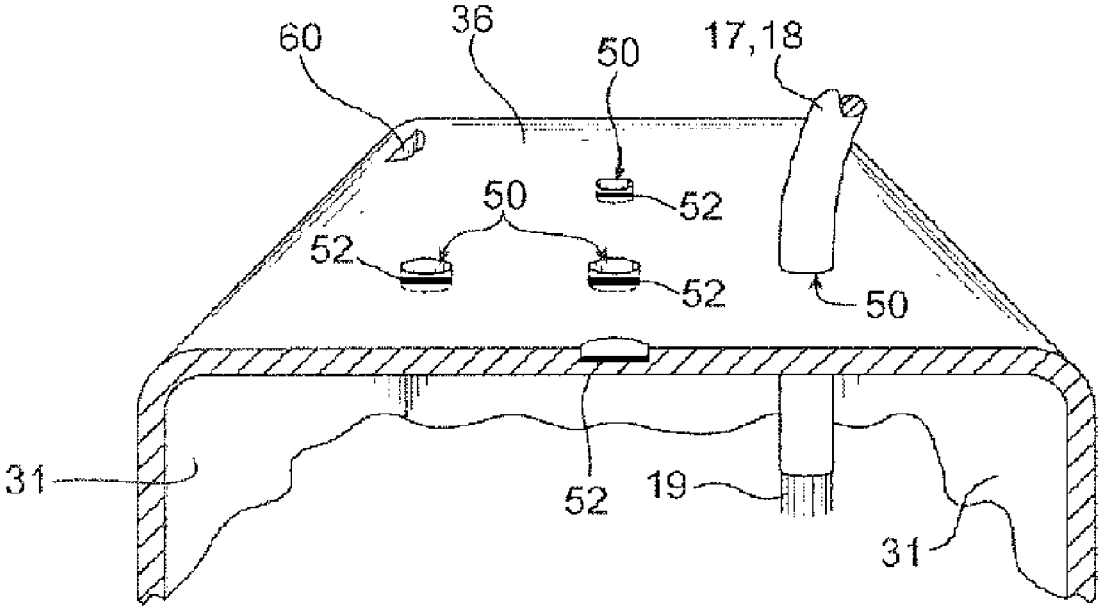
FIG. 3 is partial cutaway perspective view of an enclosure showing recesses in the enclosure walls according to the embodiments of the subject invention.

With reference again to FIGS. 2 and 2*a* and now to FIG. 3, the enclosure 14 may include one or more recesses 50 fashioned in the walls 31 of the enclosure 14. The recesses 50 may extend part of the way through the thickness of the wall 31 leaving a relatively thin membrane 52 to inhibit or restrain fluid from passing through the enclosure 14. In one embodiment, the membrane 52 may have a thickness in the range between substantially zero (0) to 0.150 inch. The thickness of the membrane 52 may be selected such that the electrical conductors 17 may pierce the membrane 52 during an assembly procedure. In this manner, a separate tool is not needed to open the recesses 50. Rather, depending on the circuit configuration, any number of recesses 50 may be opened by pushing the electrical conductors 17 through membrane 52 leaving the remaining recesses sealed. In one embodiment, the membrane 52 may have a thickness of approximately 0.050 inch. Still, any thickness of membrane 52 may be chosen as is appropriate for use with the material chosen to construct the enclosure 14 and that allows the user to manually insert the electrical conductors 17 through the membrane 52.

With continued reference to FIGS. 2 through 3, the recesses 50 may be self-sealing with respect to the girth of the electrical conductors 17. As mentioned above, the enclosure 14 may be constructed from elastically deformable material. When the electrical conductors 17 pierce the membrane 52, the material of the membrane 52 opens to allow the electrical conductors 17 to pass therethrough and subsequently closes diametrically around the girth of the sheathing 18 thereby sealing off the recess 50 from allowing fluid to pass through. Additionally, the diameter of the recess 50 may be undersized with respect to the outer diameter of the electrical conductors 17. In this way, the material around the recess 50 may expand to allow the electrical conductor 17 to pass therethrough and close back around the girth of the electrical conductor 17 thereby sealing the recesses 50 from allowing fluid to pass into the enclosure 14. In both instances, the material comprising the enclosure walls 31, having memory, may automatically seal against the electrical conductors 17 when inserted through the recess 50.

With reference again to FIGS. 2, 2*a* and 4, in one embodiment of the present invention, the enclosure 14 may include one or more weep holes 60 for releasing any fluid trapped in the enclosure 14. It will be appreciated that moisture vapor may be resident inside the enclosure 14. As condensate collects, the weep holes 60 provide means by which the fluid may be drained. Accordingly, weep holes 60 may be fashioned in the walls 31 of the enclosure 14. More specifically, weep holes 60 may be fashioned in the base 36. Four (4) weep holes 60 may be included, two (2) pairs respectively at the corners of the base 36 of the enclosure 14. Placement and spacing of the weep holes 60 may also be similar with respect to a center plane of the enclosure 14. In this manner, the enclosure 14 may be substantially symmetrical about a central plane C. It will be appreciated that any quantity and any position of the weep holes 60 may be chosen as is appropriate for use with the embodiments of the present invention. Additionally, configuration and size of weep holes 60 may be chosen with sound engineering judgment.

With reference now to all of the Figures, use and assembly of the enclosure 14 will now be discussed. In one embodiment, a receptacle 10 may be selected for a particular circuit requiring a predetermined number electrical conductors 17. The electrical conductors 17 may then be inserted respectively through the recesses 50 fashioned in the walls 31 of the enclosure 14 in a manner consistent with that described above. Once breached, the membrane(s) 52 covering the recesses 50 and/or the diameter of the recesses 50 may automatically seal against the girth of the conductor sheathing 18. The electrical conductor end may be stripped of its sheathing 18 and the wire 19 attached to the receptacle 10 as needed for communicating electrical power and/or signals to and from the circuit. The receptacle 10 may then be inserted into the enclosure 14, and the enclosure 14 mounted to the surface of an associated structure 65. In one embodiment, the enclosure 14 may be mounted to portable equipment 65*a*, and more particularly to portable welding equipment 65*b*. The rib 48 may be juxtaposed to the inner surface of the equipment structure and the assembly secured thereto by way of fasteners 68. Cover members 58, 58' may be included that fit over the receptacle 10 for covering the circumference around the enclosure 14. A gasket 66 may further be included for sealing between the cover member 58' and the exterior wall of the associated structure 65.

The invention has been described herein with reference to the disclosed embodiments. Obviously, modifications and alterations will occur to others upon a reading and understanding of this specification. It is intended to include all such modifications and alterations insofar as they come within the scope of the appended claims or the equivalence thereof.

What is claimed is:

1. An enclosure for an associated electrical receptacle, comprising: an open front side configured to receive an associated electrical receptacle, wherein the open front side further comprises a face having a raised rib for sealing against an associated mounting surface; and a substantially enclosed rear side for inhibiting fluid from contacting the associated electrical receptacle, wherein the substantially enclosed rear side includes one or more sealed recesses for receiving one or more associated electrical conductors respectively, wherein each of the one or more electrical conductors has a defined circumference and wherein each of the one or more sealed recesses comprises a seal, and wherein the one or more sealed recesses are self-sealing such that the seal of each of the one or more sealed recesses encloses around the circumference of the one or more associated electrical conductors when the one or more electrical conductors are inserted through the one or more sealed recesses respectively.

2. The enclosure as defined in claim 1, wherein the enclosure is a unitary article molded from a thermoplastic elastomer.

3. The enclosure as defined in claim 1, wherein the enclosure is constructed from melt processible elastomer.

4. The enclosure as defined in claim 1, wherein the seal of the one or more sealed recesses comprises at least a first membrane covering the one or more sealed recesses for inhibiting the passage of fluid.

5. The enclosure as defined in claim 4, wherein the at least a first membrane is sufficiently thin to be punctured, thus forming at least a first punctured membrane, by inserting the one or more associated electrical conductors into the one or more sealed recesses respectively.

6. The enclosure as defined in claim 5, wherein the at least a first punctured membrane encircles the circumference of the one or more associated electrical conductors for substantially preventing fluid from passing between the one or more sealed recesses and the one or more associated electrical conductors.

7. The enclosure as defined in claim 4, wherein the at least a first membrane is constructed at least in part from a thermoplastic elastomer.

8. The enclosure as defined in claim 4, wherein the diameter of the one or more sealed recesses are undersized with respect to the circumference of the one or more associated electrical conductors.

9. The enclosure as defined in claim 4, wherein the at least a first membrane is constructed at least in part from a thermoset polymer.

10. The enclosure as defined in claim 4, wherein the at least a first membrane is constructed from melt processible elastomer.

11. The enclosure as defined in claim 1, wherein the substantially enclosed rear side includes at least a first weep hole.

12. The enclosure as defined in claim 11, wherein the enclosure is substantially symmetrical about a center plane; and, wherein the at least a first weep hole comprises a first and at least a second weep hole fashioned on distally opposed sides of the enclosure.

13. A method of installing an electrical receptacle in a receptacle enclosure, comprising the steps of:

providing a receptacle enclosure having walls defining an open front side, wherein the open front side further comprises a face having a raised rib for sealing against an associated mounting surface, and a substantially enclosed rear side, wherein the substantially enclosed rear side includes one or more self-sealing recesses fashioned in the walls, wherein each of the one or more of the self-sealing recesses comprises a seal; providing an electrical receptacle for installation within the receptacle enclosure, the electrical receptacle having at least a first terminal for receiving at least a first associated electrical conductor; inserting the at least a first associated electrical conductor, wherein each electrical conductor has a defined circumference, into the receptacle enclosure thereby piercing the seal of the one or more self-sealing recesses, wherein seal encloses around the circumference of the electrical conductor; and, connecting the at least a first associated electrical conductor to the electrical receptacle.

14. The method as defined in claim 13, wherein the one or more self-sealing recesses are covered by one or more membranes respectively; and, wherein the one or more membranes have a thickness in the range between substantially zero to 0.150 inch.

15. The method as defined in claim 13, wherein the receptacle enclosure further comprises at least a first weep hole for draining associated fluid from within the receptacle enclosure.

* * * * *